US006014782A

United States Patent [19]

Stevenson

[11] Patent Number: 6,014,782

[45] Date of Patent: Jan. 18, 2000

[54] PROTECTIVE MATTRESS COVER

[75] Inventor: Anna Stevenson, North Salt Lake, Utah

[73] Assignee: Dream World Design, Salt Lake City, Utah

[21] Appl. No.: 08/971,349

[22] Filed: Nov. 17, 1997

Related U.S. Application Data

[60] Provisional application No. 60/045,934, May 8, 1997.

[51] Int. Cl.[7] ..... A47G 9/04

[52] U.S. Cl. ..... 5/499; 5/482; 5/907; 5/487

[58] Field of Search ..... 5/482, 485, 487, 5/498, 499, 501, 907; 40/654.01, 661, 776

[56] References Cited

U.S. PATENT DOCUMENTS

| | | | |
|---|---|---|---|
| 2,339,828 | 1/1944 | Worth | 5/600 |
| 2,537,652 | 1/1951 | Churchill | 5/499 |
| 2,596,884 | 5/1952 | Bailen | 40/776 X |
| 2,861,280 | 11/1958 | Sachs | 5/499 |
| 4,538,312 | 9/1985 | Marki et al. | 5/499 |
| 4,599,756 | 7/1986 | Koffler | 5/484 |
| 5,423,711 | 6/1995 | Dorland | 450/57 |
| 5,477,633 | 12/1995 | Leinberger | 40/661 |
| 5,497,521 | 3/1996 | Waits et al. | 5/482 X |
| 5,509,156 | 4/1996 | Smith | 5/482 |
| 5,572,754 | 11/1996 | Lazar et al. | 5/494 |
| 5,718,010 | 2/1998 | Beier | 5/907 X |

FOREIGN PATENT DOCUMENTS

| | | | |
|---|---|---|---|
| 2145330 | 3/1985 | United Kingdom | 5/499 |

*Primary Examiner*—Michael F. Trettel
*Attorney, Agent, or Firm*—Madson & Metcalf

[57] ABSTRACT

A protective mattress cover for the foot of a mattress which can fit mattresses having varying thicknesses is disclosed. The mattress cover adjustably connects to itself underneath the mattress or to the box spring decking material beneath the mattress. In this way, the mattress cover can firmly wrap mattresses having various thicknesses. The mattress cover protects the mattress from soiling during testing by a consumer. The mattress cover is preferably made of a clear material so that the mattress appearance, product information, labels and logos are not obscured.

19 Claims, 2 Drawing Sheets

PROTECTIVE MATTRESS COVER

RELATED PATENT APPLICATION

This invention is a continuation-in-part of U.S. Provisional patent application Ser. No. 60/045,934, filed May 8, 1997, entitled Protective Mattress Cover, which application is incorporated herein by reference.

FIELD OF THE INVENTION

The present invention relates to a mattress cover. More particularly, the present invention relates to a mattress cover for use in retail showrooms which protects the mattress from being soiled or damaged while a retail customer test rests the mattress.

BACKGROUND

Before a customer purchases a new mattress, retailers and manufacturers recommend that the customer "test rest" the mattress. That is, the customer should fully lay on the mattress. By fully laying on the mattress, the customer can better compare the comfort of one mattress from another. However, some customers are reluctant to fully test rest a mattress because their shoes tend to soil or damage the mattress surface. Instead, such customers simply sit on the mattress or partially lay on the mattress, with their feet extending off the mattress surface.

To encourage customers to test rest mattresses, some retailers and manufacturers have placed protective coverings over the end of the mattress. Such coverings include fitted sleeves which slide onto the end of the bed. A disadvantage of these fitted sleeves is that they tend to fall off the end of the bed. One reason the fitted sleeves fall off is because mattresses vary in depth. Although the width and length of mattresses has been standardized, the depth or thickness of mattresses typically varies from 8 inches to 15 inches and up. This makes it difficult for a sleeve cover to adequately fit various sized mattresses.

Vinyl covers have also been sewn on the foot of the mattress for protection. However, one skilled in the art will appreciate that sewing a vinyl cover requires additional manufacturing expense. Also, a sewn vinyl cover can be ripped by a consumer test resting the mattress. When this happens, the mattress must be sent back to the manufacturer for recovering and repair.

Retail showrooms often contain several different styles and brands of mattresses. Mattress manufacturers usually include prominent brand or logo labels sewn onto the mattress to aid distinguishing one mattress from another. These labels are typically located at the foot of the mattress. It is desirable to provide a means for displaying mattress product information while at the same time providing means for protecting the foot end of the mattress against soiling while being tested by the consumer.

There is, therefore, a need in the art for protective coverings which can be placed at the end of a mattress. The protective coverings should also enable product labels and information to be displayed.

Such protective mattress coverings are disclosed and claimed herein.

SUMMARY OF THE INVENTION

The present invention is directed to a mattress cover which can fit mattresses having varying thicknesses. The mattress cover wraps around the foot of the mattress and adjustably connects to itself underneath the mattress or to the box spring decking material beneath the mattress. In this way, the mattress cover can firmly wrap mattresses having various thicknesses. The mattress cover is preferably made of a clear material so that the mattress appearance, product information, labels and logos are not obscured.

DESCRIPTION OF THE INVENTION

Figure 1:
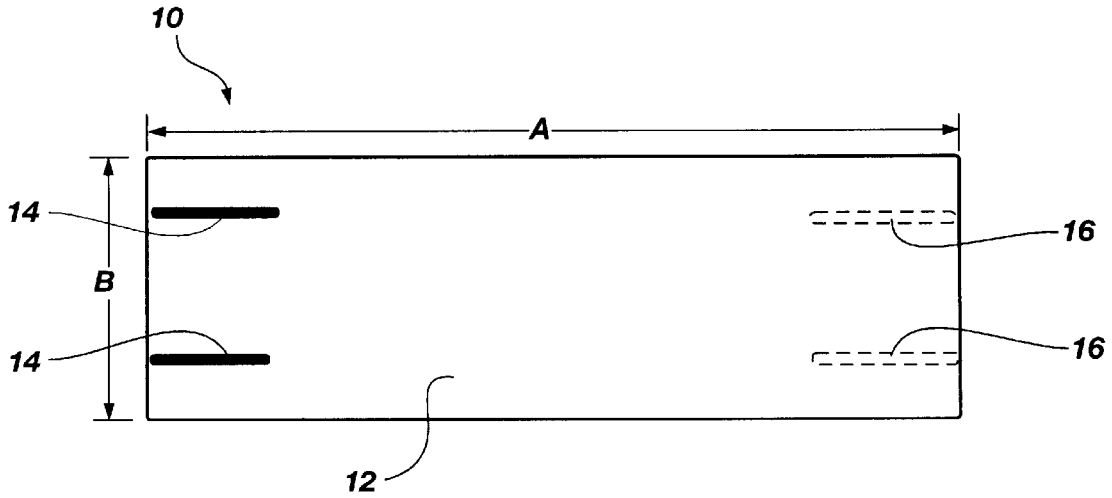
FIG. 1 is a plan view of a mattress cover within the scope of the invention.

The present invention is directed to a protective mattress cover which can fit mattresses having varying thicknesses. Referring to FIG. 1, a protective mattress cover within the scope of the present invention is shown and designated with reference numeral 10. Mattress cover 10 includes a generally elongate, rectangular web 12 of flexible material having a web length "A" and a web width "B".

It is currently preferred to construct web material 12 out of clear vinyl, although other similar clear polymeric materials can be used. It has been found that clear vinyl having a thickness of 10 gauge works well, although persons skilled in the art will appreciate that other thicknesses can be used within the scope of the present invention. The 10 gauge material is sturdy, wears well, and holds a clear pocket (described below) without wrinkling the printed material held by the pocket. One additional advantage of the vinyl material is that it can be printed to contain information about the mattress or retailer.

The web length A can vary depending on the particular size of the mattress to be covered, typically between about 100 inches to about 200 inches. For example, when the protective mattress cover 10 is used with a conventional twin size mattress, which is about 39 inches wide, the web length A is preferably about 104 inches. When the mattress cover 10 is used with a conventional queen size mattress, which is about 60 inches wide, the web length A is preferably about 160 inches, and when the mattress cover 10 is used with a conventional king size mattress, which is about 76 inches wide, the web length A is preferably about 195 inches.

The width B of web material 12 is preferably about 20 inches. This width is presently preferred because the vinyl material preferably used to make the mattress covers 10 comes in 40 inch rolls, making it convenient and efficient to simply cut the material into 20 inch strips. However, other web widths are clearly possible and within the scope of the present invention.

One or more, and preferably at least two, hook and loop fastener strips, such as VELCRO®-type hook and loop fasteners, are secured to the ends of the web material 12. The "hook" strips 14 are secured to one side of the web material 12, while the "loop" strips 16 are secured to the other side of the web material 12. The hook and loop strips 14 and 16 are secured to the web material 12 by sewing or by use of a suitable adhesive.

The number and size of the hook and loop strips 14, 16 used with the mattress cover 10 can be varied. It is currently preferred to use one inch wide hook and loop strips having a length of about 14 inches. In addition, an alternative connector instead of hook and loop strips can be used, such as grommets and elastic connectors. It has been found in some cases that the mattress cover can also be used without separate connectors by simply overlapping the polymeric material underneath the mattress. For instance, if clear vinyl material is used, the vinyl tends to stick or cling to itself. An overlap from 5 to 10 inches has been successfully used.

Figure 2:
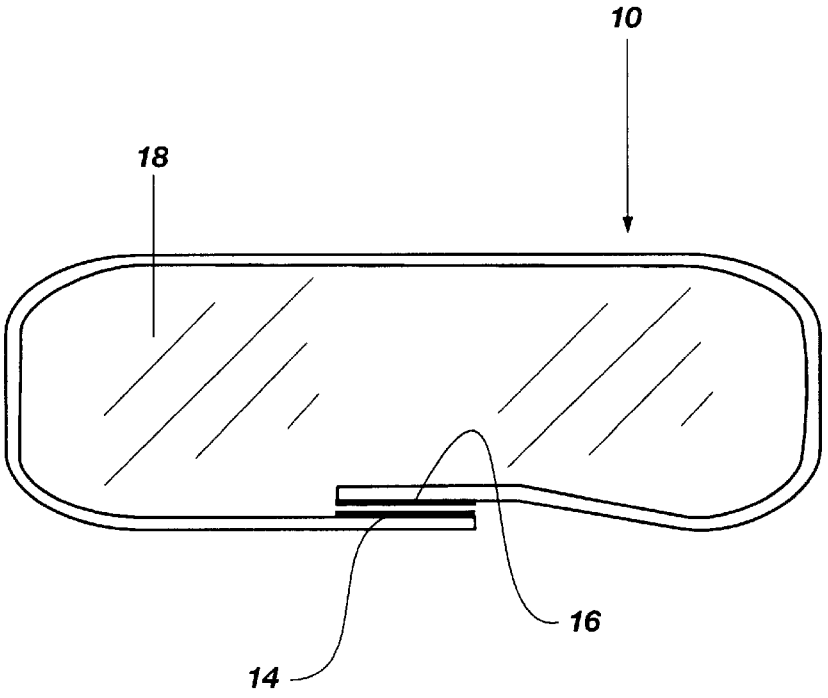
FIG. 2 is an end view of a mattress having the cover of FIG. 1 installed thereon.
Figure 3:
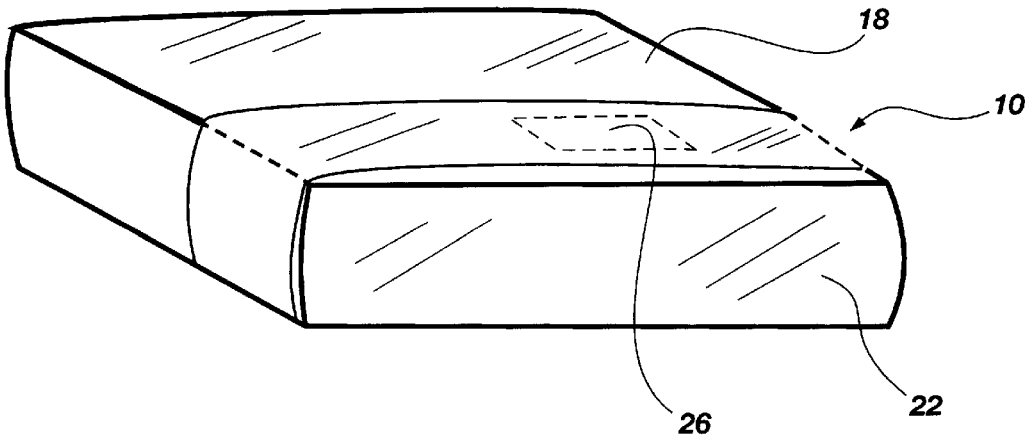
FIG. 3 is a perspective view of a mattress and box spring having a mattress cover within the scope of the invention.

In use, the mattress cover 10 wraps around the foot of a mattress 18, and the hook and loop strips 14, 16 attach to each other, as shown best in the end view of FIG. 2 and the perspective view of FIG. 3. The hook and loop strips 14, 16 permit a secure and adjustable fit for various mattress depths.

One skilled in the art will understand that the shape and configuration of the mattress cover 10 can be varied from the rectangular shape shown. For example, the corners can be rounded or angled.

Figure 4:
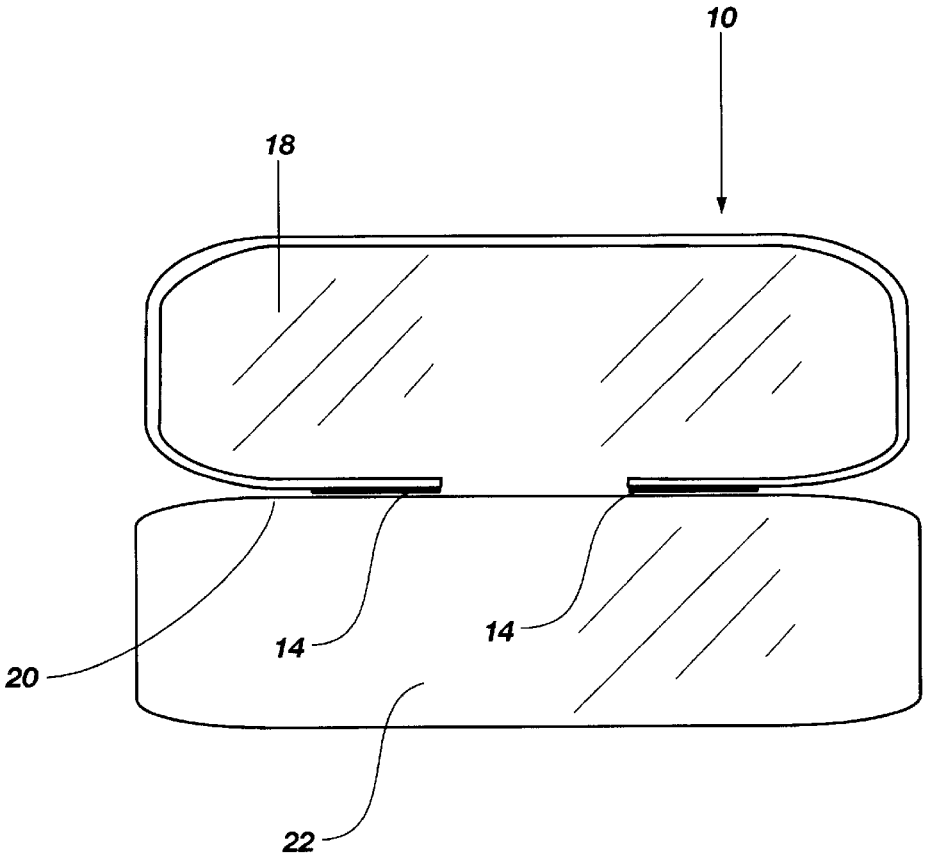
FIG. 4 is an end view of an alternative embodiment of a mattress cover shown as installed on a mattress and box spring.

Another embodiment within the scope of the present invention is shown in FIG. 4. The embodiment shown in FIG. 4 is designed to wrap around the foot of the mattress 18 and to be attached to the decking cloth 20 on the top of the box spring 22. Instead of having a "hook" strip on one side of the mattress cover and a "loop" strip on the other side of the mattress cover, the embodiment shown in FIG. 4 has "hook" strips 14 located on the front side at both ends of the mattress cover 10. This configuration allows the mattress cover 10 to wrap around the mattress 18 and attach to the decking cloth 20 on the box spring 22 underneath the mattress 18, as shown in an end view in FIG. 4. The embodiment shown in FIG. 4 is preferably used with queen and king size mattresses. The web length A of this embodiment is preferably about 135 inches, but this length can easily be varied.

FIG. 3 shows an optional clear pocket 26 which can be placed on the underside of the mattress cover 10 for retaining printed sheets, such as sales information or product specifications, under the clear mattress cover. The pocket 26 is preferably made of clear 2 mil vinyl which electrostatically attaches to the mattress cover 10. If necessary, the clear pocket 26 can also have one or more adhesive strips to secure the pocket 26 to the mattress cover 10. The size of the pocket 26 can vary depending on the size of the sheet to be held by the pocket. A pocket 26 size of approximately 12 inches by 12 inches has been found adequate for most applications.

It will be appreciated that the present invention provides a protective mattress cover for placement at the foot of a mattress which protects the mattress from damage or soiling while customers test rest the mattress. The mattress cover within the scope of the present invention can be adjusted for various mattress thicknesses. The mattress cover can also be constructed of clear material so that mattress labels, logos and product information can be displayed through the mattress cover.

The present invention may be embodied in other specific forms without departing from its essential characteristics. The described embodiments are to be considered in all respects only as illustrative and not restrictive. The scope of the invention is, therefore, indicated by the appended claims rather than by the foregoing description.

What is claimed is:

1. A removable mattress cover comprising:

a generally elongate web of flexible clear polymeric material dimensioned and configured to wrap around a foot portion of a mattress hich is at least 8 inches thick, wherein the web has a first end and a second end, and wherein the web is sufficiently long to enable the first and second ends to overlap each other a distance which varies depending on the size of the mattress when the web is wrapped around the foot portion of a mattress; and means for adjustably securing the web to itself at its overlapping first and second ends at an overlap distance which varies depending on the size of the mattress.

2. The removable mattress cover as defined in claim 1, wherein the web comprises hook and loop fasteners attached to and located upon opposite ends and opposite surfaces of the web, wherein the hook and loop fasteners are configured to overlap each other a distance which varies depending on the size of the mattress, so as to adjustably secure the web to itself at its overlapping portion.

3. The removable mattress cover as defined in claim 1, wherein the web is constructed of a material which removably adheres to itself at its overlapping portion.

4. The removable mattress cover as defined in claim 1, wherein the web is constructed of clear vinyl material.

5. The removable mattress cover as defined in claim 1, wherein the web is generally rectangular in shape.

6. The removable mattress cover as defined in claim 1, wherein the web is approximately twenty inches wide.

7. The removable mattress cover as defined in claim 1, wherein the web has a length in the range from about 100 inches to about 200 inches.

8. The removable mattress cover as defined in claim 1, further comprising a clear pocket located underneath the web for retaining printed mattress or sales information.

9. A removable mattress cover comprising:

a generally rectangular elongate web of flexible material dimensioned and configured to wrap around a foot portion of a mattress which is at least 8 inches thick, wherein the web has a first end and a second end, and wherein the web is sufficiently long to enable the first and second ends to overlap each other a distance which varies depending on the size of the mattress when the web is wrapped around the foot portion of a mattress; and hook and loop fasteners attached to and located upon opposite ends and opposite surfaces of the web, wherein the hook and loop fasteners are configured to overlap each other a distance which varies depending on the size of the mattress, so as to adjustably secure the web to itself at its overlapping portion.

10. The removable mattress cover as defined in claim 9, wherein the web is constructed of clear vinyl or clear polymeric material.

11. The removable mattress cover as defined in claim 9, wherein the web has a length in the range from about 100 inches to about 200 inches.

12. The removable mattress cover as defined in claim 11, wherein the web is approximately twenty inches wide.

13. The removable mattress cover as defined in claim 12, further comprising a clear pocket located underneath the web for retaining printed mattress or sales information.

14. A removable mattress cover comprising:

a generally elongate web of flexible clear polymeric material dimensioned and configured to wrap around a foot portion of a mattress which is at least 8 inches thick, wherein the web does not overlap itself when wrapped around the foot portion of a mattress, and wherein the web comprises hook fasteners located at opposite ends of the web to adjustably secure the web to decking cloth of a box spring underneath the mattress; and means for adjustably securing the web to the foot portion of a mattress.

15. The removable mattress cover as defined in claim 14, wherein the web is constructed of clear vinyl material.

16. The removable mattress cover as defined in claim 14, wherein the web is generally rectangular in shape.

17. The removable mattress cover as defined in claim 14, wherein the web is approximately twenty inches wide.

18. The removable mattress cover as defined in claim, 14, wherein the web has a length in the range from about 100 inches to about 200 inches.

19. The removable mattress cover as defined in claim 14, further comprising a clear pocket located underneath the web for retaining printed mattress or sales information.

* * * * *

UNITED STATES PATENT AND TRADEMARK OFFICE

CERTIFICATE OF CORRECTION

PATENT NO. : 6,014,782
DATED : January 18, 2000
INVENTOR(S) : Stevenson

It is certified that error appears in the above-identified patent and that said Letters Patent is hereby corrected as shown below:

In column 4, line 1, please change "hich" to --which--.

Signed and Sealed this

Sixth Day of February, 2001

*Attest:*

Q. TODD DICKINSON

*Attesting Officer*

*Director of Patents and Trademarks*